US006722535B1

(12) United States Patent
Flach

(10) Patent No.: US 6,722,535 B1
(45) Date of Patent: Apr. 20, 2004

(54) CONTAINER FOR FLAMMABLE LIQUID

(76) Inventor: James N. Flach, 19709 W. Eldorado Dr., Eustis, FL (US) 32726

( * ) Notice: Subject to any disclaimer, the term of this patent is extended or adjusted under 35 U.S.C. 154(b) by 44 days.

(21) Appl. No.: 10/274,538

(22) Filed: Oct. 21, 2002

(51) Int. Cl.[7] ..... B65D 83/00
(52) U.S. Cl. ..... 222/467; 518/109
(58) Field of Search ..... 222/465.1, 466, 222/467, 518, 109

(56) References Cited

U.S. PATENT DOCUMENTS

| | | | |
|---|---|---|---|
| 2,014,730 | A | 9/1935 | Gorman et al. |
| 2,065,785 | A | 12/1936 | Anschicks |
| 3,447,724 | A | 6/1969 | Fiddyment |
| 3,469,747 | A | 9/1969 | Richmond, Jr. |
| 3,727,807 | A | 4/1973 | Flider |
| 4,065,024 | A | 12/1977 | Atwell |
| 4,640,446 | A | 2/1987 | Walker |

*Primary Examiner*—Philippe Derakshani
(74) *Attorney, Agent, or Firm*—William M. Hobby, III

(57) ABSTRACT

The present invention relates to a flammable liquid storage container having a container body and a pouring spout attached to the body and extending therefrom. A handle is attached to the container body for supporting the container. A cutoff valve is located in the pouring spout pouring end portion having a slidable valve element for cutting off the flow of liquid from the container when in a closed position. An operating handle operatively connects the valve element from moving the valve element between an open position for pouring a liquid from the container in a closed position for shutting off the flow of liquid from the container. A vent chamber is located outside the container body and is sealed from the atmosphere when the valve element is closed. The vent chamber opens to the atmosphere when the valve element is opened and also forms a pressure relief valve for opening when a predetermined pressure is reached within the vent chamber. A drain tube forms a passageway between the container body and the vent chamber for draining liquid from the vent chamber.

12 Claims, 6 Drawing Sheets

CONTAINER FOR FLAMMABLE LIQUID

BACKGROUND OF THE INVENTION

This invention relates to new and improved containers and especially to safety containers for flammable liquids.

Closed containers for flammable liquids are known in the art and prescribe to safety regulations enforced by governmental and industrial agencies. Any improved containers must meet or exceed the existing safety regulations.

Some of the factors which are pertinent to these containers for flammable liquids include the method of filling, pouring, and venting of the safety can. More particularly, the pouring of a liquid from a closed container requires the intake of air to avoid an air-lock inside the container. A number of disadvantages are found in the spouts and in the air intake vents of safety cans currently in use. When the air intake device is in or near the pouring opening, the incoming air reacts on the flowing liquid to create turbulence that makes the flow erratic. When small openings are added for the sole purpose of taking in air during the pouring operation, they may become clogged by debris from either the outside or the inside of the can. Also, when completely filled, cans are tilted and the air vent must open if it is to be effective. As a result, liquid can sometimes spill out of an air vent. This can be hazardous, as when pouring over a hot engine.

Prior U.S. patents for containers for liquid include the R. J. Anschicks U.S. Pat. No. 2,065,785 for a closure for a can and receptacles and more particularly to closure devices for the discharge spouts of portable cans of the type used as containers for kerosine or volatile liquids. In this container, a handle on the side of the container operates a valve element adjacent the spout to open the spout for pouring the liquid and, at the same time, opens an air vent running from the top of the can into the spout. Pulling the handle pulls the valve to open the spout so that liquid can be poured from the can.

In R. H. Richmond, Jr., U.S. Pat. No. 3,469,747, a storage can for flammable liquids has a handle hinged to the top of a can in which the carrying handle controls the pouring spout by opening and closing a cover for the pouring spout.

In E. W. Fiddyment, U.S. Pat. No. 3,447,724, a is pouring spout and vent construction for a liquid storing and dispensing container has a valve plate attached to the top walls and slidably mounted thereto for simultaneously covering a pouring spout opening and air vent. A U-shaped handling valve acts as a pivoting bracket to slide the valve plate between open and closed positions.

The Gorman et al., U.S. Pat. No. 2,014,730, is a safety can for gasoline or flammable liquids which has a valve positioned at the spout base for opening or closing the discharge opening from the housing into the spout. The valve is spring loaded to maintain the opening into the spout in a closed position when the handle is not actuated.

The Atwell, U.S. Pat. No. 4,065,024, is a safety closure and portable receptacle having a pivoted closure for the opening to the container, which pivoted opening is interconnected with the handle which operates a valve and can be used for locking the cap in a closed position.

The Walker, U.S. Pat. No. 4,640,446, provides a safety gas can with plural nestable dispensing means. The Flider, U.S. Pat. No. 3,727,807, is for a safety container for flammable liquids which has a pair of openings which are opened and closed by a single handle. One of the openings is for the pouring spout and the other for a vent. One of the vent openings has a spring biased safety cap which is opened when the internal pressure exceeds a predetermined level.

The present invention relates to a flammable liquid storage container which controls the pouring spout with an internal valve in the pouring spout. It simultaneously controls venting into the can during the pouring. The vent is interconnected with a pressure relief valve for opening the vent when a predetermined internal pressure is reached within the container. In addition, the handle of the container is interconnected with a separate filling opening cap for opening the cap on the container and for sealing the container when the cap is closed.

SUMMARY OF THE INVENTION

The present invention relates to a flammable liquid storage container having a container body and a pouring spout attached to the body and extending therefrom. A handle is attached to the container body for supporting the container. A cutoff valve is located in the pouring spout pouring end portion having a slidable valve element for cutting off the flow of liquid from the container when in a closed position. An operating handle operatively connects the valve element from moving the valve element between an open position for pouring a liquid from the container in a closed position for shutting off the flow of liquid from the container. A vent chamber is located outside the container body and is sealed from the atmosphere when the valve element is closed. The vent chamber opens to the atmosphere when the valve element is opened and also forms a pressure relief valve for opening when a predetermined pressure is reached within the vent chamber. An air vent forms a passageway between the container body and the vent chamber for venting the container when the valve element is in an open position and also vent when the valve element is in a closed position under a predetermined internal container pressure. A spring is mounted for biasing the valve element in a closed position and for biasing the pressure relief valve in a closed position so that the container can control the flow of liquid therefrom by an operating handle controlling a valve element against a spring to hold the valve element in a closed position. Air in the container is vented to the outside when the operating handle is actuated or when the pressure builds up within the container. A connecting rod connects the handle to the valve element in the pouring spout and has a rod guide positioned in the spout for slidably supporting the connecting rod. The spring mounted around the rod supports one end against the vent chamber pressure relief element and the other end to bias the valve element in a closed position. A lockable cap is attached to the handle for the container which handle is hinged to rotate to open the container. When the cap is locked to the container in a closed position, the handle can be used for portage and pouring.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
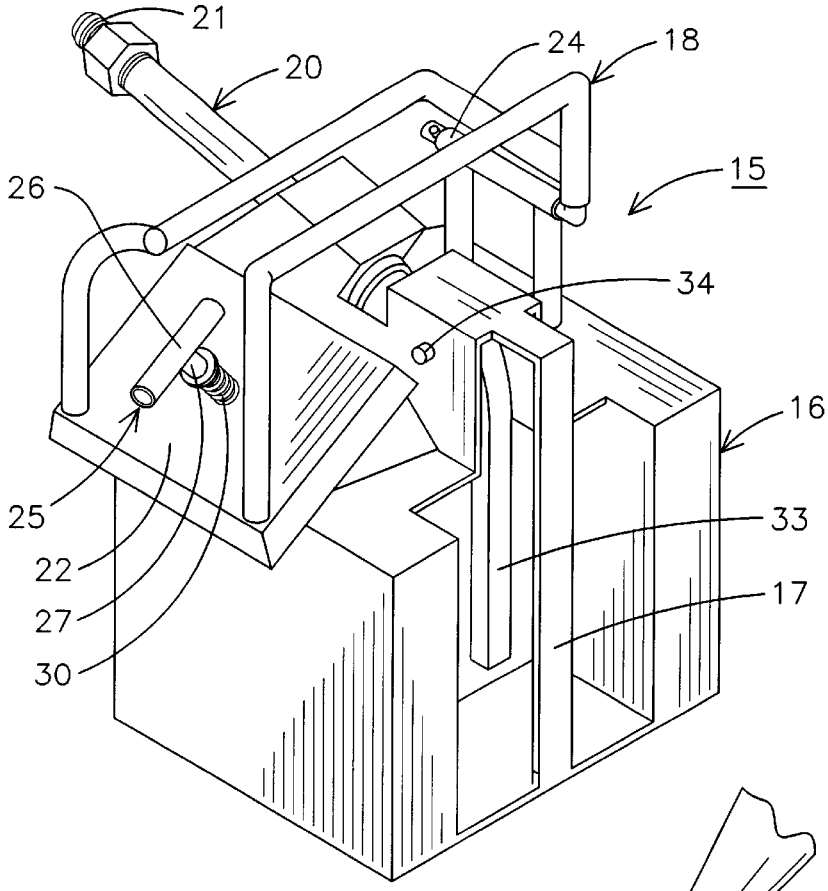
FIG. 1 is a perspective view of a flammable liquid storage container in accordance with the present invention.
Figure 2:
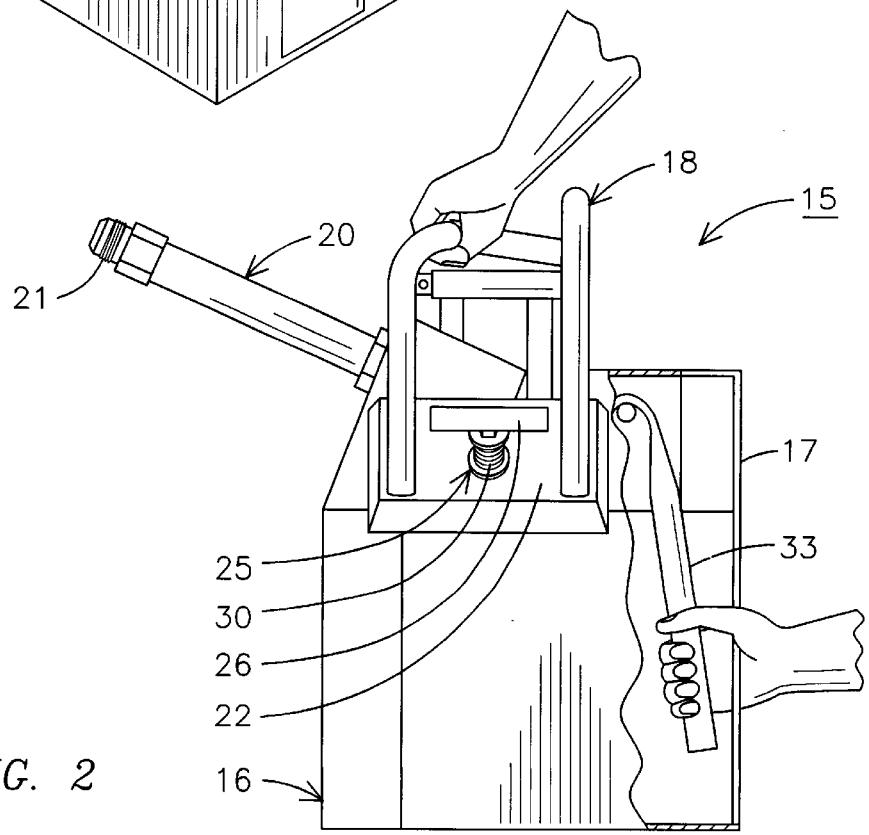
FIG. 2 is a side elevation of the container of FIG. 1.
Figures 6, 7:
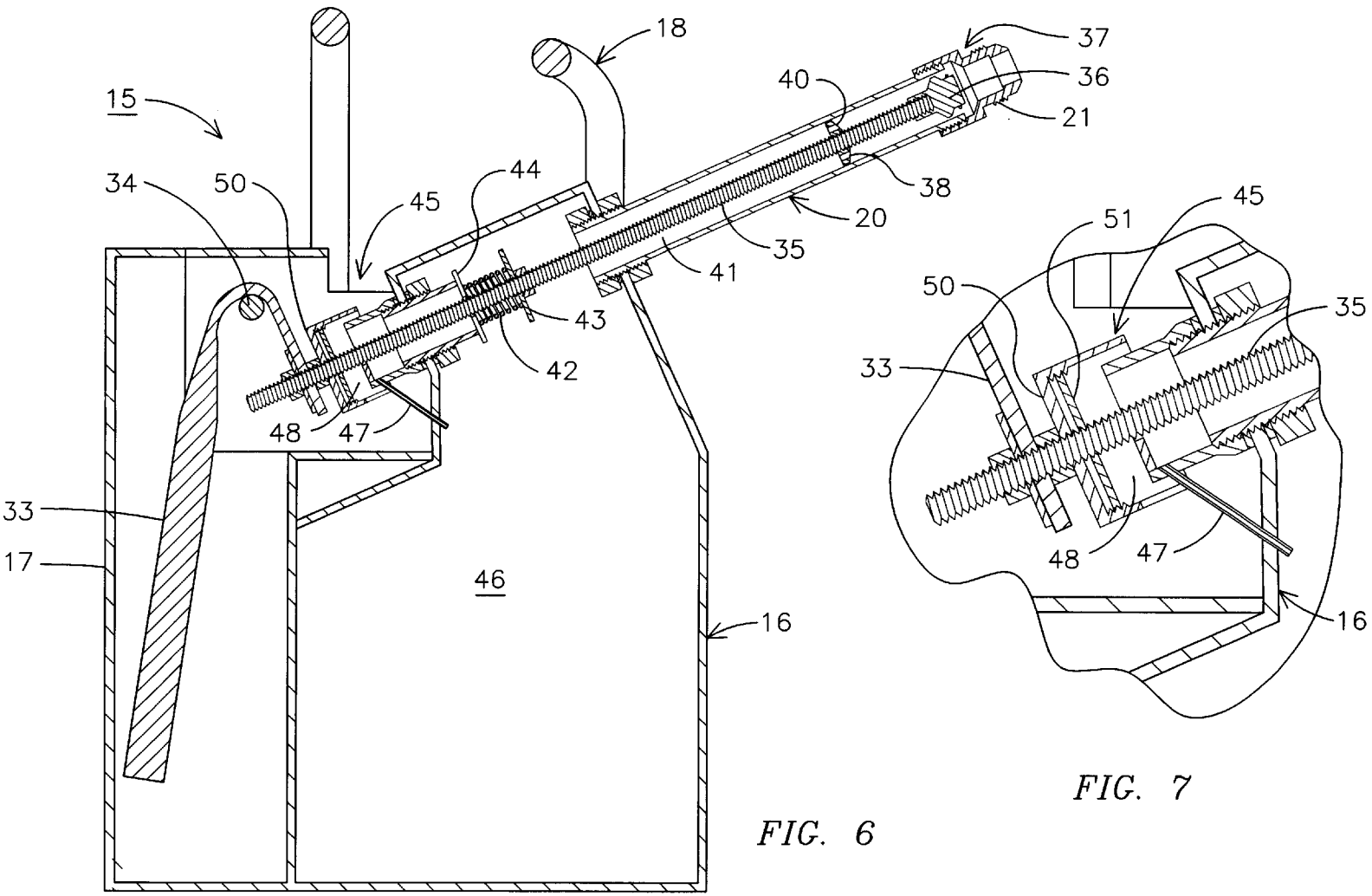
FIG. 6 is a sectional view of the container of FIGS. 1–5 with the handle moved to open the pouring spout valve.
FIG. 7 is a partial enlarged section of the vent chamber in the position of FIG. 6.
Figure 8:
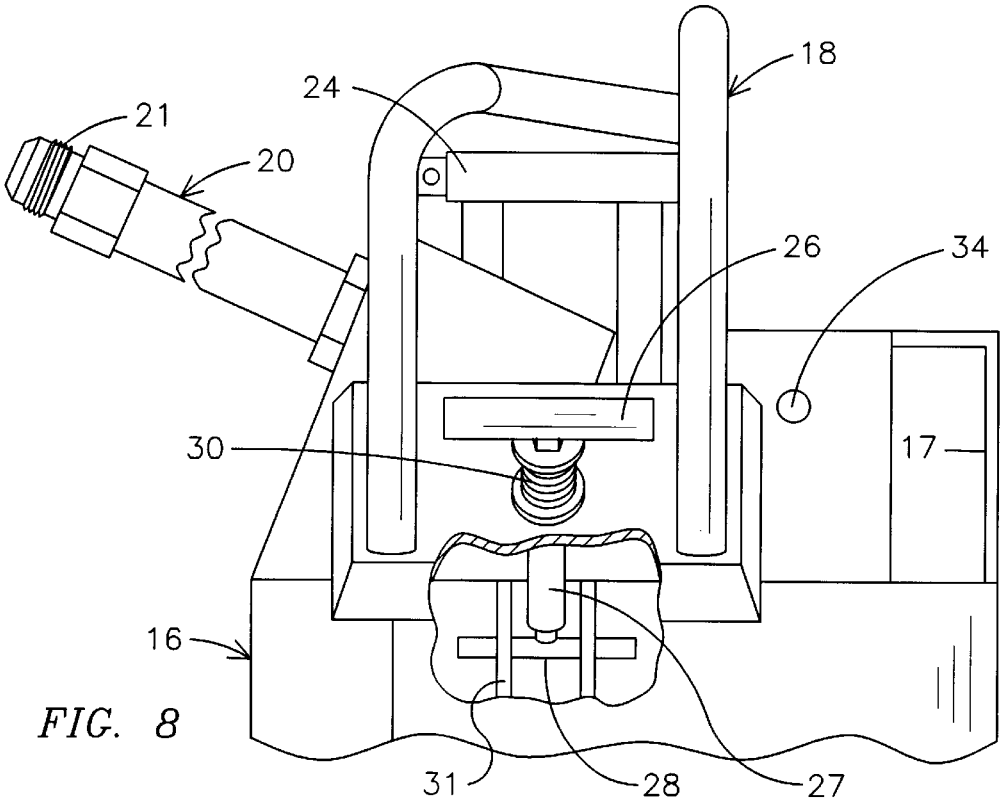
FIG. 8 is a partial perspective view with a cutaway portion showing the locking of the container cap.
Figure 9:
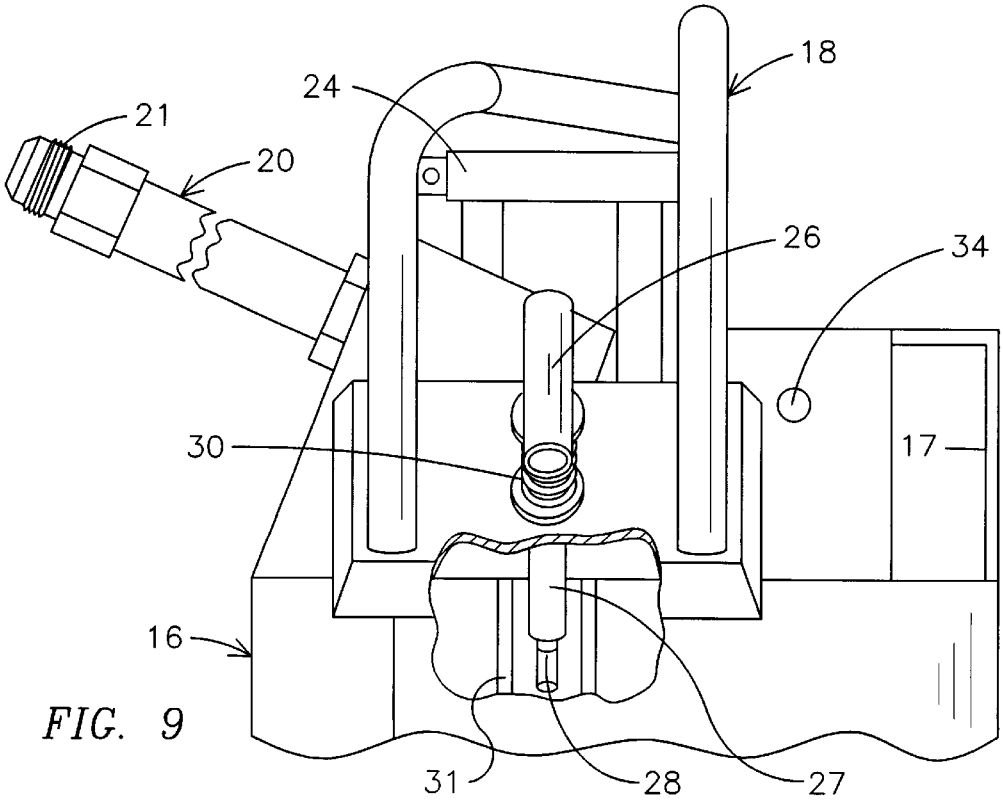
FIG. 9 is a partial perspective having a cutaway view of the locking section for the cap.
Figure 10:
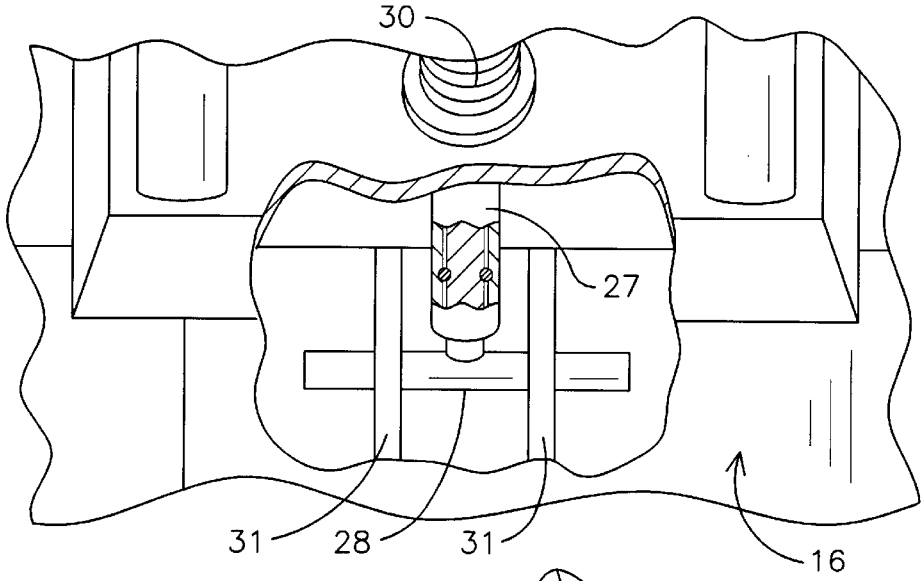
FIG. 10 is a partial perspective of the locking mechanism for the cap in a locked position.
Figure 11:
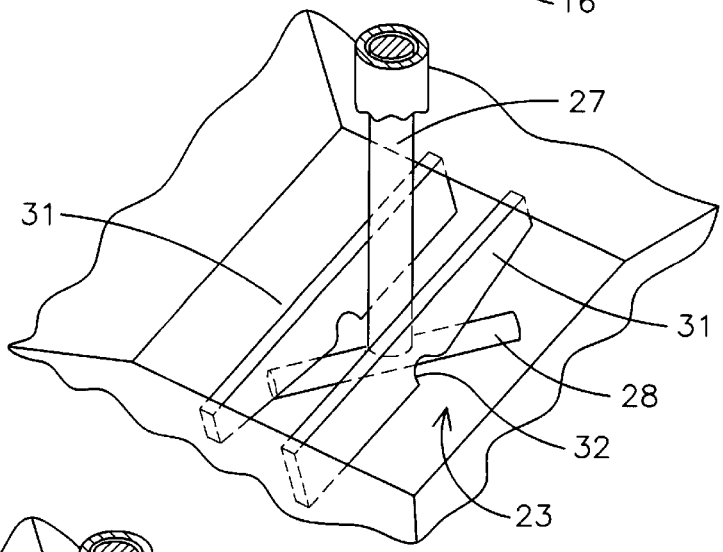
FIG. 11 is a partial perspective view of the locking mechanism for the cap in a partially opened position.
Figure 12:
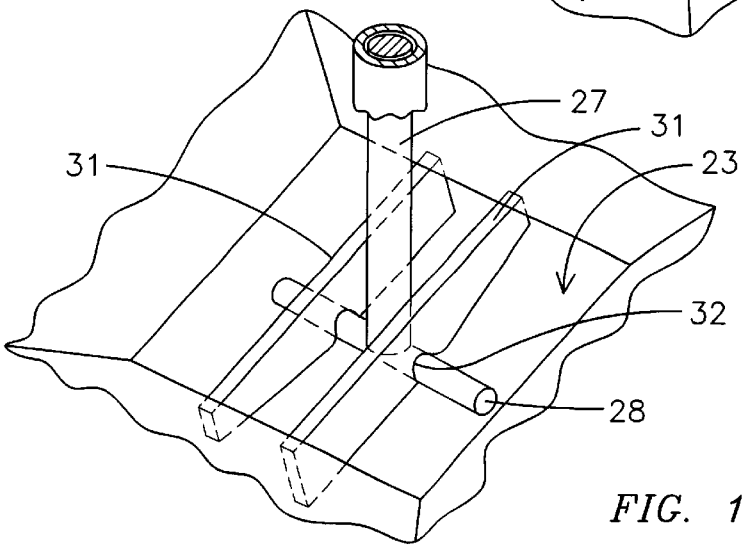
FIG. 12 is a partial perspective of the locking mechanism in a locked position.

Referring to the drawings FIGS. 1–11, a container containing flammable liquids 15 has a container body 16 having a rear supporting handle 17 and a top supporting handle 18. A spout 20 has a discharge end 21 and is connected to the container body 16. The handle portion 18 is fixedly attached to a container cover 22 which covers opening 23 to the container body 16. The handle 18 is hinged with a hinge 24 so that rotating the handle 18 on the hinge 24 raises the flammable container can 15 opening cap 22. The opening cap 22 has a cap lock 25 having a handle 26 attached to a rod 27 and a transverse extending locking member 28. The cap lock 25 has a biasing spring 30 wrapped therearound, as seen in FIG. 1. Cap lock 25 operates by pushing the handle 26 to push the rod 27 against the spring 30 to push in the locking member 28 between a pair of locking bars 31, as seen in FIGS. 8 to 11, each having a notch 32 therein. Locking member 28 is pushed between the locking arms 31, as seen in FIGS. 9 and 10, and rotated until the locking member 28 fits in the notches 32 where it is held in place by the force of the spring 30, as shown in FIGS. 8 to 10. When in this locked position, the handle 18 can be lifted for toting the container 15 while the handle portion 17 can be used in pouring a flammable liquid from the container body 16 through the spout 20 while gripping the operating handle 33 which is used to open a valve to release the liquid from the spout 20 out the discharge end 21.

Figures 4, 5:
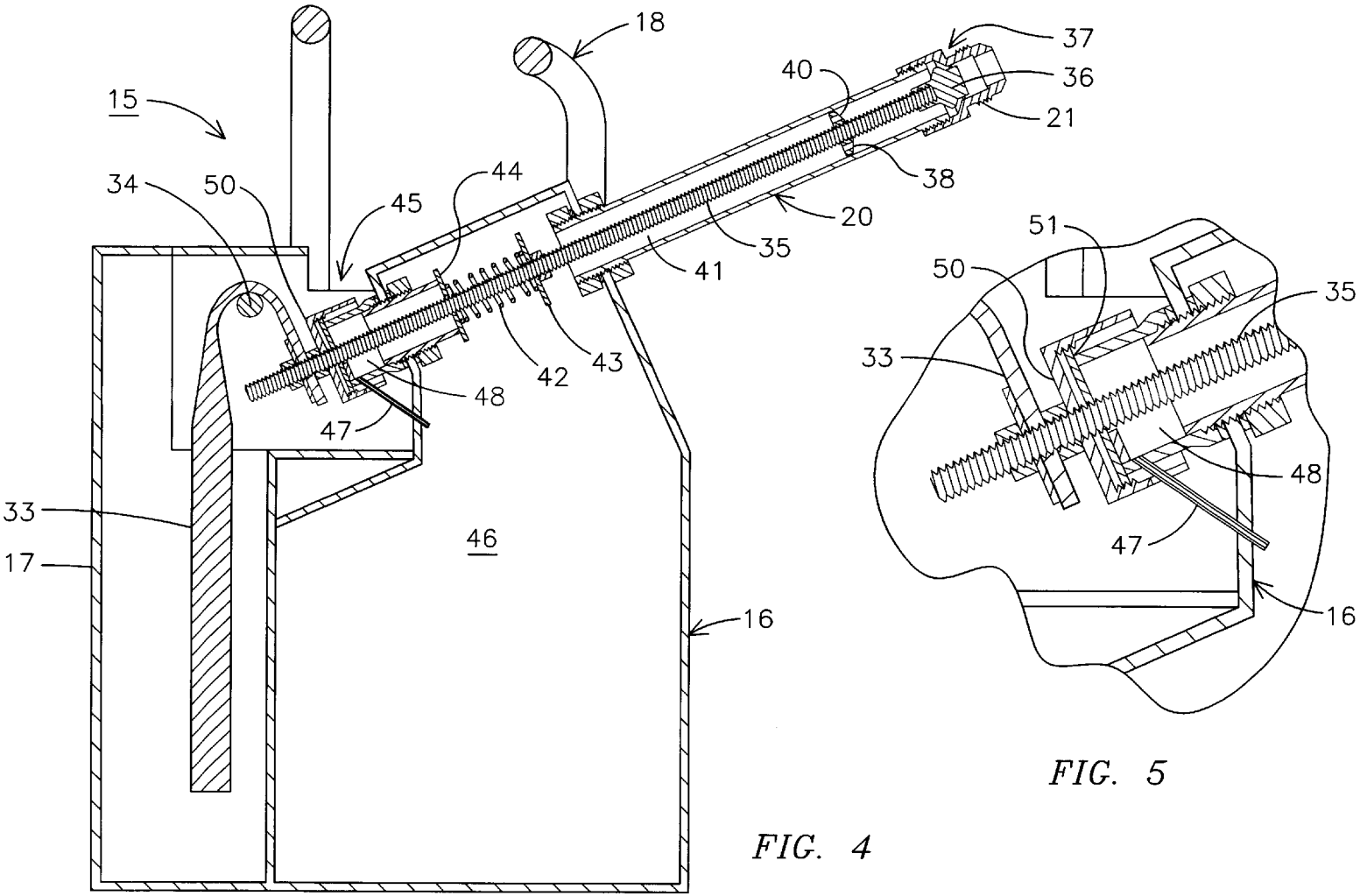
FIG. 4 is a sectional view taken through the containers of FIGS. 1–3.
FIG. 5 is a partial sectional view taken through the container vent chamber.

The handle 33 is hinged over a hinge pin 34, as seen in FIGS. 4 and 6, and is connected to a connecting rod 35 at one end. The connecting rod 35 extends through the spout 20 and is connected to a valve element 36 for operating valve 37 located at the discharge end 21 of the spout 20. The connecting rod 35 passes through a rod guide 38 which maintains the rod 35 in position. The rod guide 38 has a plurality of openings 40 therethrough to allow liquid passing through the spout passageway 41 to pass around the rod guide 38. The valve element 36 is kept in a closed position by a spring 42 and is held at one end by a spring holding member 43, as seen in FIGS. 4 and 6. The spring 42 is supported on the other end against the top side 44 of the chamber. Top side 44 has holes therein for air entry. A drain tube 47 is connected between the inside 46 of the container body 16 and the inside 48 of the venting chamber 45 to allow liquid sloshed into vent chamber 45 to drain into the main chamber 46. The venting chamber 45 however is sealed against the atmosphere when the valve 37 is in a closed position, as shown in FIG. 4, but when the handle 33 is actuated, it pulls the connecting rod 35 to pull the valve element 36 to an open position for pouring liquid through the spout 20 and out the discharge end 21, as shown in FIG. 6. This compresses the spring 42 which then returns the valve element 36 to a closed position once the handle 33 is released. The handle is, however, connected to the vent chamber 45 valve element 50 having a sealing element 51 therein which is pulled opened to open the vent chamber 45 to the atmosphere when the handle 33 is pulled to open the valve element 36, as shown in FIGS. 6 and 7. This allows the container 15 to be vented to atmosphere whenever the valve 36 is open for pouring a liquid from the container through the spout 20. The valve 37 is located towards the discharge end 21 of the spout which advantageously prevents dripping of the liquid left in the spout if the valve were located away from the end of the spout.

As seen in FIGS. 4–7, the venting chamber 45 extends through the container body 16 having part of it open to the atmosphere with the other part extending into the container body 16. Pressure that builds up in the closed container chamber is vented into the venting chamber 45 from the container body 16 until it exceeds the pressure from the spring 42. If the pressure builds up within the container body 16 when the container 15 is in storage, for instance, by the heating of the container, the pressure will be vented into the vent chamber 45 through the openings in top 44 where it can drive against the vent chamber valve element 50 to pull the rod 35 against the spring 42 to slightly open the valve element 50 to release the build up of air pressure within the container into the atmosphere. This way, the container remains sealed against spillage or vaporizing into the atmosphere until the pressure builds up sufficiently or until a pouring operation is initiated.

Figure 3:
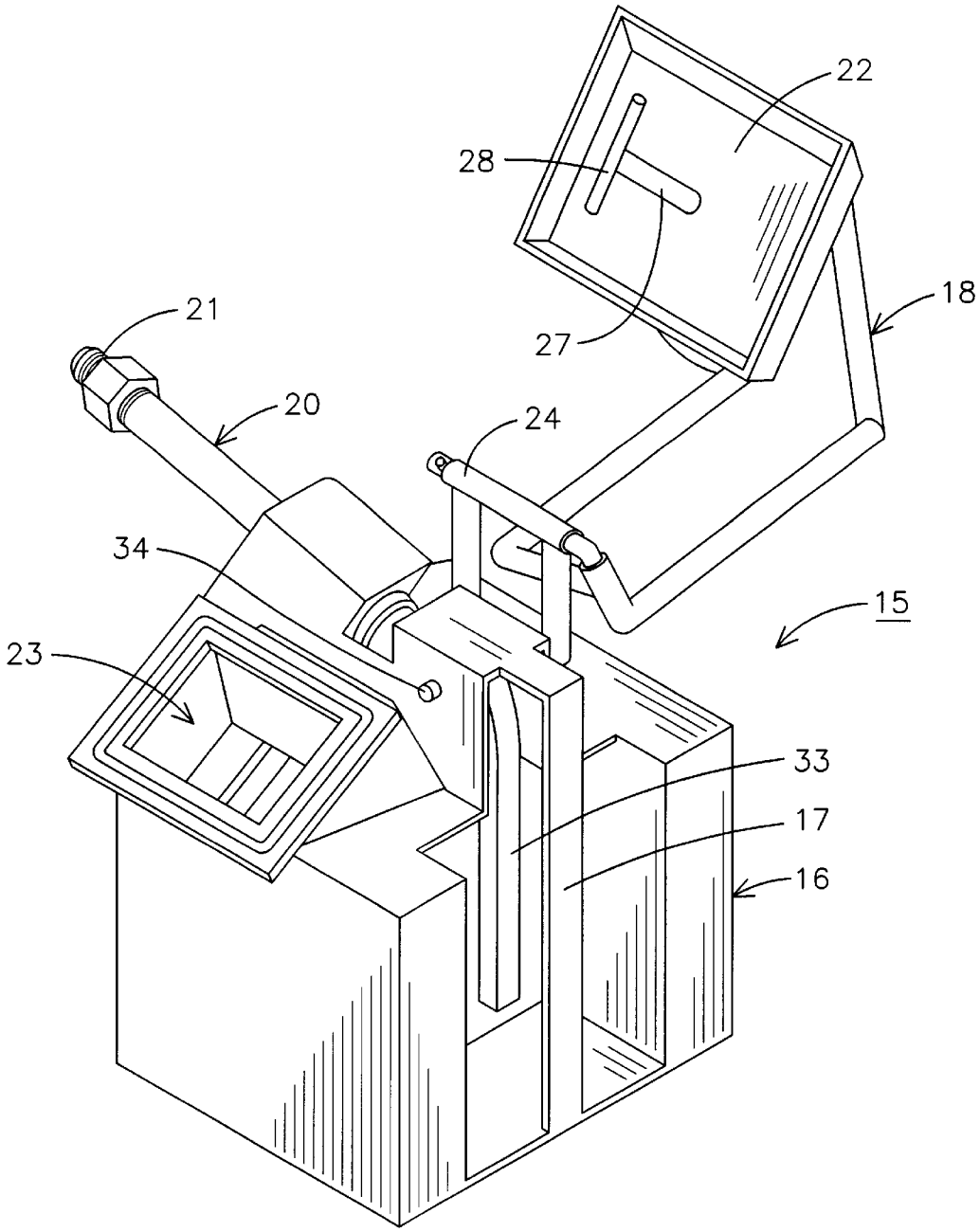
FIG. 3 is a perspective view of the containers of FIGS. 1 and 2 having the cap opened for adding or removing liquids from the container.

In operation, the lock handle 26 can be turned to release the cap 22 so that the handle 18 can be rotated on the hinge 24 to open the cap, as shown in FIG. 3, for either filling the container or removing liquids to empty the container. The cap 22 can then be rotated back in place and locked with a cap lock 25. To pour from the container, a person can hold the container and pull the handle 33 which pulls the connecting rod 35 to open the valve 36 for the pouring of liquid from inside the container body 16 and simultaneously open the vent chamber 45 venting valve 50 to allow atmospheric air into the vent chamber and through vent holes in the top side 44 and into the inside 46 of the container body 16 during the pouring operation. The vent chamber is always located away from the liquid being poured by the location of the vent chamber 45. Once the pouring operation is finished, the handle 33 is released and the spring 42 drives the connecting rod 35 to close the valve 36 and simultaneously closes the venting chamber 45 valve 50. When the pressure builds up within the container body 16, the pressure will also build up within the venting chamber 45 until the pressure builds up sufficiently to drive the vent chamber valve element 50 and the valve 21 against the spring 42 to allow the release of gas pressure within the container while maintaining the container in a normally closed position with a sealed vent.

It should be clear at this time that a container for flammable liquids has been provided which has a plurality of safety features providing for ease of use in filling and pouring from the container while preventing the build up of gas pressure within the container and venting the container only when the pouring valve is actuated. However, the present invention should not be construed as limited to the forms shown which are to be considered illustrative rather than restrictive.

I claim:

1. A flammable liquid storage container comprising:

a container body;

a pouring spout attached to said container body and extending therefrom and having a pouring end portion;

a handle attached to said container body for supporting said container;

a cutoff valve located in said pouring spout pouring end portion having a slidable valve element for cutting off the flow of liquid from said container when in a closed position;

an operating handle operatively connected to said valve element for moving said valve element between open position for pouring a liquid from said container and a closed position for shutting off the flow of liquid from said container;

a vent chamber located outside said container body, said vent chamber being sealed from the atmosphere when said valve element is closed and open to the atmosphere when said valve element is open and forming a pressure release valve for opening when a predetermined pressure is reached therein;

a drain forming a passageway between said container body and said vent chamber for draining said vent chamber and liquid therein; and a spring mounted for biasing said valve element in closed position and biasing said pressure release valve in a closed position;

whereby a liquid container controls the flow of liquid therefrom by an operating handle controlled valve element spring loaded to a closed position and which vents the container to air when said operating handle is actuated and when pressure builds up in said container.

2. The flammable liquid storage container in accordance with claim 1 having a connecting rod connecting said handle to said valve element whereby moving said handle slides said valve element from a closed to an open position for pouring a liquid from said container.

3. The flammable liquid storage container in accordance with claim 2 having a rod guide positioned in said spout for slidably supporting said connecting rod therein.

4. The flammable liquid storage container in accordance with claim 3 in which said spring is mounted around said rod and supported on one end against said vent chamber pressure relief valve element.

5. The flammable liquid storage container in accordance with claim 4 in which said spring is mounted around said rod and supported on the other end against a spring holding member attached to said rod.

6. The flammable liquid storage container in accordance with claim 1 in which said container has an opening thereinto and an opening cap for sealing said container opening.

7. The flammable liquid storage container in accordance with claim 6 in which said container opening cap has a cap lock for locking said cap to said container to seal said container opening.

8. The flammable liquid storage container in accordance with claim 7 in which said container handle is hingedly attached to said container body and attached to said cap for opening said cap by rotating said handle when said cap is unlocked.

9. A flammable liquid storage container comprising:

a container body having an opening therein;

a pouring spout attached to said container body and extending therefrom and having a pouring end portion;

a handle hingedly attached to said container body for supporting said container;

a container opening cap for covering and sealing said container opening;

a cap lock for locking said cap to said container body to cover and seal said container opening; and said container handle being attached to said cap for opening said cap by rotating said handle when said cap is unlocked whereby a flammable liquid storage container has a handle and cap combination.

10. A flammable liquid storage container in accordance with claim 9 in which cap lock has a rod extending through said cap and having a locking handle on one end thereof and a transverse locking member on the other end thereof so that rotation of said locking member will lock said cap in a sealed position.

11. A flammable liquid storage container in accordance with claim 10 in which cap lock rod has a spring therearound biasing said locking member rod into a locked position.

12. A flammable liquid storage container in accordance with claim 11 in which cap has a gasket seal for sealing said cap to said container body over said opening thereinto.

* * * * *